US005992208A

United States Patent [19]

Hofele et al.

[11] Patent Number: 5,992,208

[45] Date of Patent: Nov. 30, 1999

[54] PRESS ARRANGEMENTS WITH AUTOMATIC TOOL EXCHANGE AND METHOD OF TOOL EXCHANGE

[75] Inventors: Hans Hofele, Göppingen; Matthias Speidel, Eschenbach, both of Germany

[73] Assignee: Schuler Pressen GmbH & Co., Germany

[21] Appl. No.: 09/083,880

[22] Filed: May 26, 1998

[30] Foreign Application Priority Data

May 23, 1997 [DE] Germany ..... 197 21 614

[51] Int. Cl.[6] ..... B21D 43/05; B21D 43/20

[52] U.S. Cl. ..... 72/405.08; 72/405.1

[58] Field of Search ..... 72/405.1, 405.08, 72/405.09, 405.11, 405.01, 405.16

[56] References Cited

U.S. PATENT DOCUMENTS

| | | | |
|---|---|---|---|
| 4,557,134 | 12/1985 | Kuppinger . | |
| 4,881,398 | 11/1989 | Daubner | 72/405.08 |
| 5,248,288 | 9/1993 | Kamiya | 72/405.1 |
| 5,363,683 | 11/1994 | Thudium | 72/405.1 |

FOREIGN PATENT DOCUMENTS

| | | |
|---|---|---|
| 0 191 397 B1 | 4/1991 | European Pat. Off. . |
| 33 34 021 C1 | 9/1983 | Germany . |
| 41 24 083 A1 | 1/1993 | Germany . |

OTHER PUBLICATIONS

Ford Motor Company, Universal Station, Chapter 6, pp. 6–1, 3, 5, 7, 9, 11, 14, 16, 18, 20, 22, 24, 26, 28, 30, 32, 34, 49, 50, 52, 54, 57, 59, 61, 63, 65 and 68, 1994.

*Primary Examiner*—Daniel C. Crane
*Attorney, Agent, or Firm*—Evenson, McKeown, Edwards & Lenahan P.L.L.C.

[57] ABSTRACT

A press arrangement has a sliding tables which carry molds and are provided in the press stations. Holding systems on the sliding tables or on the molds are used for receiving holders which are arranged on the intermediate station arranged between the press stations. The holders carry templates for the intermediate deposition of workpieces. In addition, the holders have receiving devices for receiving workpiece-specific parts of the transfer system, particularly suction frames. During the mold exchange, the intermediate depositing station is operated such that it receives the suction frames by way of the associated holders. Thereafter, the holders are deposited on the holding systems.

17 Claims, 5 Drawing Sheets

PRESS ARRANGEMENTS WITH AUTOMATIC TOOL EXCHANGE AND METHOD OF TOOL EXCHANGE

BACKGROUND AND SUMMARY OF THE INVENTION

This application claims the priority of German application 197 21 614.5, filed in Germany on May 23, 1997, the disclosure of which is (are) expressly incorporated by reference herein.

The present invention relates to a press arrangement having at least two press stations, particularly a multistation press, sliding tables arranged in the press stations for receiving molds as required, the sliding tables being movable out of the respective press station, a transfer system which is used for the workpiece transport and which has workpiece holders, which can be separated from the transfer system, for the temporary holding of workpieces, at least one intermediate depositing device which is arranged between two press stations and which is provided with workpiece depositing apparatus as well as with a receiving device for the workpiece holders.

The present invention also relates to a method for tool exchange on a press arrangement having at least two press stations, particularly on multistation presses, sliding tables, which can be moved out of the press stations and on which molds are held, during the process, workpiece holders of a transfer system used for the workpiece transport being transferred to an intermediate depositing device which, in addition to workpiece receiving devices, has corresponding devices for receiving the workpiece holders, and relate also to a use of an intermediate depositing device pertaining to a press arrangement having at least two press stations, sliding tables arranged in the press stations for receiving molds as required, the sliding tables, being movable out of the respective press station, a transfer system which is used for the workpiece transport and which has workpiece holders which can be separated from the transfer system for the temporary holding of workpieces, and at least one intermediate depositing device which is arranged between two press stations and which is provided with devices for depositing workpieces as well as with a receiving device for the workpiece holders.

As a rule, presses or press arrangements have workpiece-dependent components which are to be exchanged, as required, for example, when the production is changed. First, these components are molds whose bottom mold part is held on a sliding table and whose top mold part is held on a press slide. The sliding table can usually be moved out in the lateral direction of the press or the press arrangement. In addition, the workpiece-dependent components comprise parts of the transfer system which is used for the conveying of the workpieces from press station to press station. The transfer system frequently has holding devices (e.g., vacuum suction devices) whose position and number is workpiece-determined.

The vacuum suction devices are usually held on suction frames which, in turn, are held on cross traverses of a two-axis transfer. The suction frames are workpiece-specific. Additional workpiece-specific elements are found on intermediate depositing devices which are arranged between two press stations and temporarily receive the workpieces without any machining being carried out on them. For receiving the workpieces, the intermediate depositing devices have depositing means called "templates" whose shape, size and position are dependent on the respective workpiece to be deposited. The holding means and the templates form the so-called tooling.

The change of all components, that is, of the mold, of the holding means and of the depositing means is to take place as automatically as possible and/or at low manual expenditures.

EP-A-0 191 397 describes a transfer press having intermediate depositing devices is known whose templates are transferred before the mold exchange to corresponding holding systems of the sliding table or of the mold disposed on this sliding table. For the transfer, the intermediate depositing device has a separate transfer device which is formed by a toothed rack and by a spring mechanism for guiding the template on a straight path to the sliding table. Devices for changing workpiece-specific elements of the transfer device are, however, not shown.

DE 41 24 083 A1 shows a transfer press line in which intermediate depositing devices are arranged between individual press stations and are moved laterally out of the press line during the mold exchange. The intermediate depositing devices hold the depositing templates used for receiving the workpieces so that they can be swivelled about a transverse axis. In addition, holding systems are provided at the intermediate depositing devices for receiving suction devices which are part of the transfer device. During the mold exchange, the intermediate devices, together with the depositing templates and the suction devices, are moved laterally out of the press. For this purpose, a corresponding clearance must be provided in the area of the press stands.

DE 33 34 021 C1 discloses a large-piece transfer press having an intermediate depositing device which has a gripping and holding device for depositing templates. For the mold exchange, these templates can be connected with the mold. For transporting the depositing templates from the intermediate depositing device to the molds, the gripping and holding device is used which, for this purpose, has toothed racks which are disposed to be slidable in the transport direction and are correspondingly driven and on whose outer end the templates are held. The exchange of workpiece-specific elements of the transfer system is not, however, taken into account in this case.

An object of the present invention is to provide a press arrangement which permits a mold and tool exchange at low manual expenditures.

Another object to provide a method for carrying out a mold and tool exchange.

These objects are achieved by a press arrangement in which at least one sliding table carries at least one holding device for the workpiece holders separated from the transfer system, and the intermediate depositing device has at least one transfer device for receiving and transferring the workpiece holders from the transfer system to the holding device.

The method of the present invention also achieves these objects by receiving the workpiece holders from the transfer system by way of the intermediate depositing device and transferring them to at least one holding device which is carried by the sliding table or the mold, and by using the intermediate depositing device for transferring the workpiece holders to a holding device provided on at least one of the sliding tables.

In addition to the sliding tables, which are in any event present and which carry molds which can be exchanged as required, the press arrangement according to the invention has a transfer system with workpiece-specific workpiece holding apparatus (suction frames) and intermediate depositing devices with also workpiece-specific workpiece depositing apparatus (templates). In addition, the intermediate depositing devices have transfer devices which are set up for taking over the workpiece holding apparatus of the transfer system and for transferring them to corresponding holding devices which are provided on the sliding tables and/or molds.

As a result, the intermediate depositing device can be used during the mold exchange as a handling device for transferring the workpiece holding apparatus from the transfer system to the sliding tables. The intermediate depositing device will then deposit the workpiece depositing apparatus and the workpiece holding apparatus simultaneously or successively on the holding device of the sliding table or of the mold resting thereon.

This arrangement and approach permit in particular the deposition of the workpiece holding apparatus at a point on the sliding table or the mold which cannot be reached by the transfer system itself. For example, the holding device for the workpiece holding apparatus may be arranged at a very low level. The intermediate depositing device bridges the distance between the transfer system and the holding device. Consequently, the tooling, i.e., the workpiece depositing apparatus and the workpiece holding apparatus, can be arranged at a low level. This benefits the mold exchange during which the mold is, for example, by way of a crane, lifted off the sliding table and another mold is placed on the sliding table.

As required, the holding device may also be provided on the mold which can then be stored with the pertaining tooling. Assignment problems between workpiece holding apparatus, workpiece depositing apparatus and molds are almost impossible. This approach simplifies the storage to great advantage.

Preferably, only the specifically constructed workpiece holding apparatus of the transfer system is exchanged. This means that, for example, carrying rails and cross traverses remain in the press arrangement and suction frames carried by the cross traverses are exchanged. The cross traverses remaining in the transfer system results in a noticeable saving of cost. For reducing weight, the cross traverses are often produced from carbon fiber materials so that every other, otherwise required set of cross traverses would clearly have cost disadvantages. Because of the fixedly mounted cross traverses and as the result of the weight reduction, there is an improvement of the dynamics and a reduction of the required driving energy.

High-expenditure and weight-intensive coupling devices for connecting the cross traverses are unnecessary. Separate holders for the workpiece depositing apparatus and the workpiece holding apparatus can be provided on the mold or on the sliding table as well as a holding arrangement which carries the workpiece depositing apparatus and, as required, receives the workpiece holding apparatus, whereby the holding arrangement is fastened on the mold-side or sliding-table-side holder.

The above arrangement is particularly advantageous if at least one supporting tube extending through in the transverse direction is part of the holding arrangement, on which supporting tube the workpiece depositing apparatus, such as the templates, are held. The supporting tubes may have individual holding elements for receiving the workpiece holding apparatus. The supporting tubes bridge the machine width in the transverse direction so that several workpiece holding apparatuses can be disposed on a supporting tube arrangement which, in turn, is again disposed on the holders of the sliding table or of the mold. The supporting tube arrangement is preferably fixedly connected with the templates and therefore forms the support thereof and thus forms an intermediate holding system for the holding apparatus. This intermediate holding system bridges, for example, a waste shaft adjoining the sliding table.

The intermediate depositing device is preferably disposed on a support so that it can be swivelled about a transverse axis. The support is also disposed on a lifting head so that it can also be swivelled about a transverse axis. The lifting head is preferably held so that it can be adjusted in at least two axes, preferably in three axes. By way of the swivelling of the support, different swivelling positions of the workpiece situated on the template can be adjusted. The swivelling of the templates has the purpose of changing these templates from their working position into a passive or depositing position. Thereby, the templates are movable via the sliding tables between the stands of one of the presses. While the transfer device, for example, a pin connected with the supporting tube, in the normal operative position of the templates, points to the lifting head and is therefore essentially horizontally aligned, it will stand up vertically when the templates swivel into the passive position. In this position, the pin will be ready to receive the holding apparatus.

Staying spaces are assigned to the holding apparatus and the depositing apparatus (templates) which, in the transfer direction, are arranged in front of and behind the mold or the sliding table and which mutually overlap with respect to the transverse direction. This permits a space-saving housing of the tooling while the accessibility to the mold is simultaneously good.

Other objects, advantages and novel features of the present invention will become apparent from the following detailed description of the invention when considered in conjunction with the accompanying drawings.

DETAILED DESCRIPTION OF THE DRAWINGS

Figure 1:
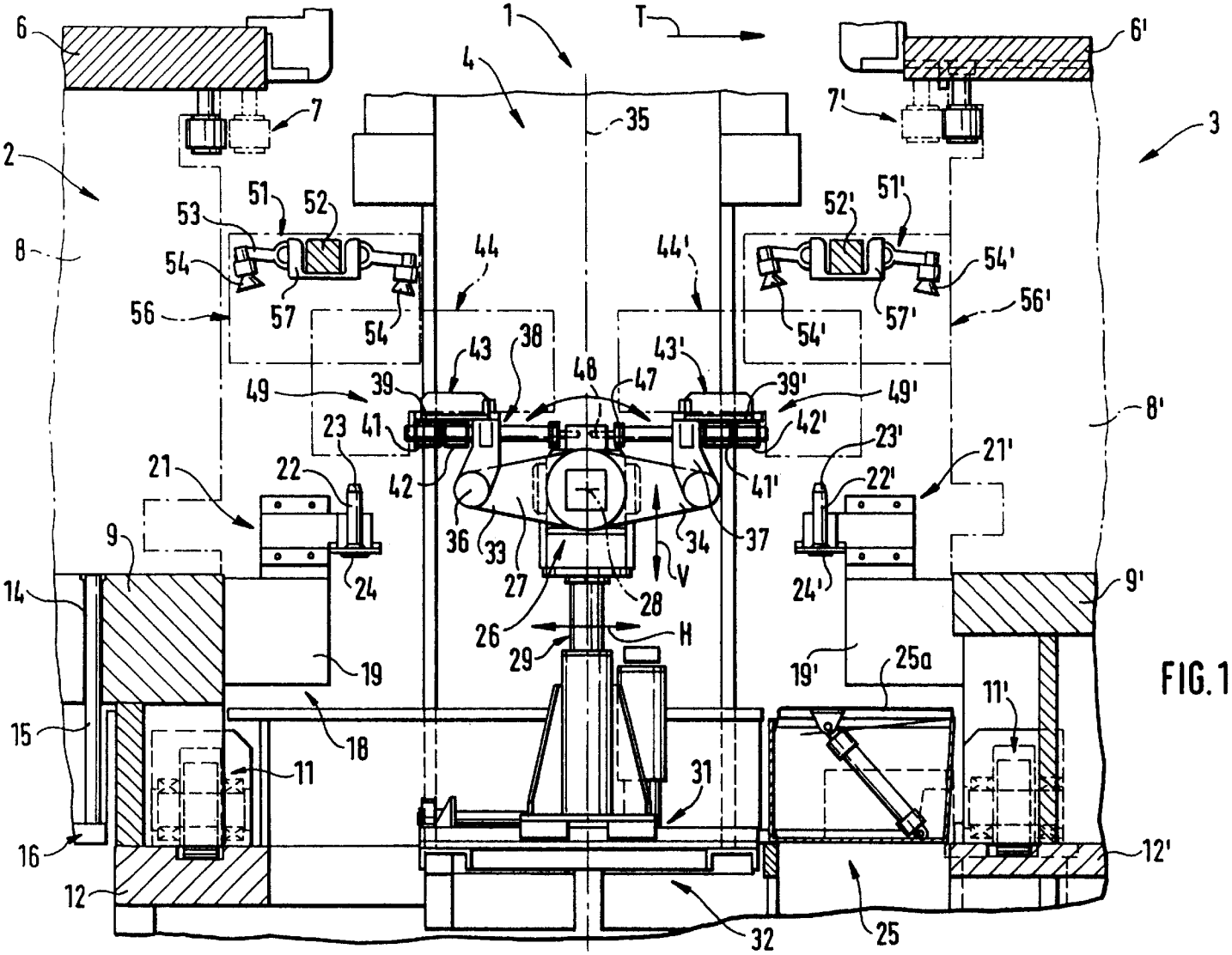
FIG. 1 is a partial, schematic side view of a press arrangement having an intermediate depositing device and the tool exchange system according to the present invention in an operative position.

FIG. 1 illustrates a press arrangement designated by numeral 1 which comprises a press station 2 shown only partially, an intermediate depositing station 4 and a second press station 3, as well as additional press stations (which are not shown in detail) and, as required, also intermediate depositing stations. The press stations 2, 3 essentially have identical constructions so that the following description of the press station 2 also refers to the press station 3 which to this extent has the same references numbers but, for the purpose of a differentiation, are primed.

In the press station 2, a slide 6 is arranged to move up and down vertically and on which, by way of corresponding clamping devices 7, the top mold part of a mold 8 which is illustrated only by its contour is fastened. The bottom mold part of this mold 8 is disposed on a sliding table 9 which is arranged below the slide 6 and, for the mold exchange, can be moved laterally out of the press arrangement 1. For this purpose, rotatably disposed rollers 11 are used which are provided on the sliding table 9 and run in corresponding guiding tracks 12 arranged transversely to the longitudinal direction of the press. If, as in the present example, the press station 2 is constructed as a drawing station and the next press station 3 is constructed as a forming station, the sliding table 9' has a continuous construction, whereas openings 14 are provided in the sliding table 9 for receiving studs 15 which are supported on a pressure pad 16.

Tool receiving devices 18 are constructed on the sliding table 9. These include at least two unsupported projections 19 which extend horizontally away from the sliding table. In FIG. 1, both projections are outlined above one another. The projections 19, which are spaced from and parallel to one another, each have an element 21 which carries a vertically upward directed pin 22. This pin 22 has an upwardly projecting free end 23 and an opposite end 24 fastened to the carrying element 21.

Directly adjacent to the sliding table 9', a waste shaft 25 may be arranged which is closed off by a pneumatically or hydraulically operated flap 25*a* which can be opened as required.

The intermediate depositing station designated generally by numeral 4 is arranged between the press stations 2, 3 and has a lifting head 26 which carries a two-armed swivel support 27 swivellably about a transverse axis 28. A second corresponding swivel support 27, with respect to the transverse direction, is congruent with the swivel support 27 and is spaced therefrom in parallel. The lifting head 26 is held on a column 29 which can be telescoped so that it can be adjusted in the vertical direction V (double arrow) in a targeted manner. The column 29 can be adjusted in a targeted manner by way of a carriage guide 31 in a horizontal direction H which coincides with the transport direction T. In the same manner as the vertical adjustment, the drive takes place by electric motors which are controlled by a conventional control device which need not be shown in detail. As required, the guide 31 itself may be disposed on a transverse guide 32 so that the column 29 and thus the swivel head 26 can be adjusted in a targeted manner in the transverse direction.

The swivel support 27 is constructed as a symmetrical two-armed lever whose first end 33 points toward the press station 2 and whose second end 34 points toward the press station 3. The swivel support 27 is symmetrical with respect to a vertical transverse plane 35 so that the following description of the elements connected with the end 33 correspondingly applies to the elements connected with the end 34, but whose reference numerals are also provided with a prime for the purpose of a differentiation.

At the free end 33 of the swivel support 27, an arm 37 is fastened which can be swivelled about a transverse axis 36 and whose angular position is determined by an electrically controlled drive. The free end of the arm 37 carries a coupling device 38 whose one half is fastened on the arm 37 and whose other half is fastened on a carrier plate 39. This carrier plate 39 is, in turn, fixedly connected with two transverse tubes 41, 42 constructed as a box section with a square cross-section which carry templates 43 used as workpiece depositing apparatus.

The templates 43 are workpiece-specific and, as a function of the workpiece to be received, can completely or partially take up the area 44. In addition, the transverse tubes 41, 42 carry at least two receiving pins 46 which are spaced parallel to one another, reach through the two transverse tubes 41, 42 and are fixedly connected therewith. The free end of the receiving pin 46 carries a contact collar 47, with a pin 48 extending away from this collar 47.

Together with the receiving pin 46, the transverse tubes 41, 42 form a holder 49 which, by way of corresponding appropriately sized openings, can be fitted upon the pin 22 of the tool receiving device 18 and which is provided for receiving suction frames 51 used for workpiece holding. The suction frame 51 is held by a cross traverse 52 of a transfer system and is detachably connected therewith. The suction frame 51 carries suction elements 54 which are held at the ends of suction arms 53. The position and the length of the suction arms 53 as well as the number, position and optionally also the size of the suction elements 54 are workpiece-specific. Based on a given cross traverse position, the area 56 is therefore obtained )the hatched portion) in which the suction elements 54 are situated.

The suction arms 53 are held on a base frame 57 which carries connecting devices for a connection with the cross traverse 52. In addition, the base frame is provided with at least one, preferably several vertical bore(s) for receiving the pin part 48 of the receiving pin 46. The connecting devices for establishing the connection with the cross traverse can be controlled pneumatically, electromagnetically or mechanically, for example, by a relative movement between the cross traverse 52 and the base frame 57 in the transverse direction. In the press arrangement 1 as above described, the tooling, i.e., the suction frame 51 and the templates 43, are changed in the following manner.

The working position of the intermediate depositing station 4 is illustrated in FIG. 1 wherein the arms 37, 37' are swivelled into such a position that the templates 43, 43' point upward such that workpieces can be deposited thereon. The vertical position is adjusted by the column 29, while the desired longitudinal and transverse positions are adjusted by the guide 31 and the transverse guide 32. As required, the swivel support 27 can be swivelled out of the horizontal position. In this manner, the intermediate depositing station can be used as a pure depositing device or for reorienting (e.g., tilting) the workpieces as well as for bridging short transport paths.

Figure 2:
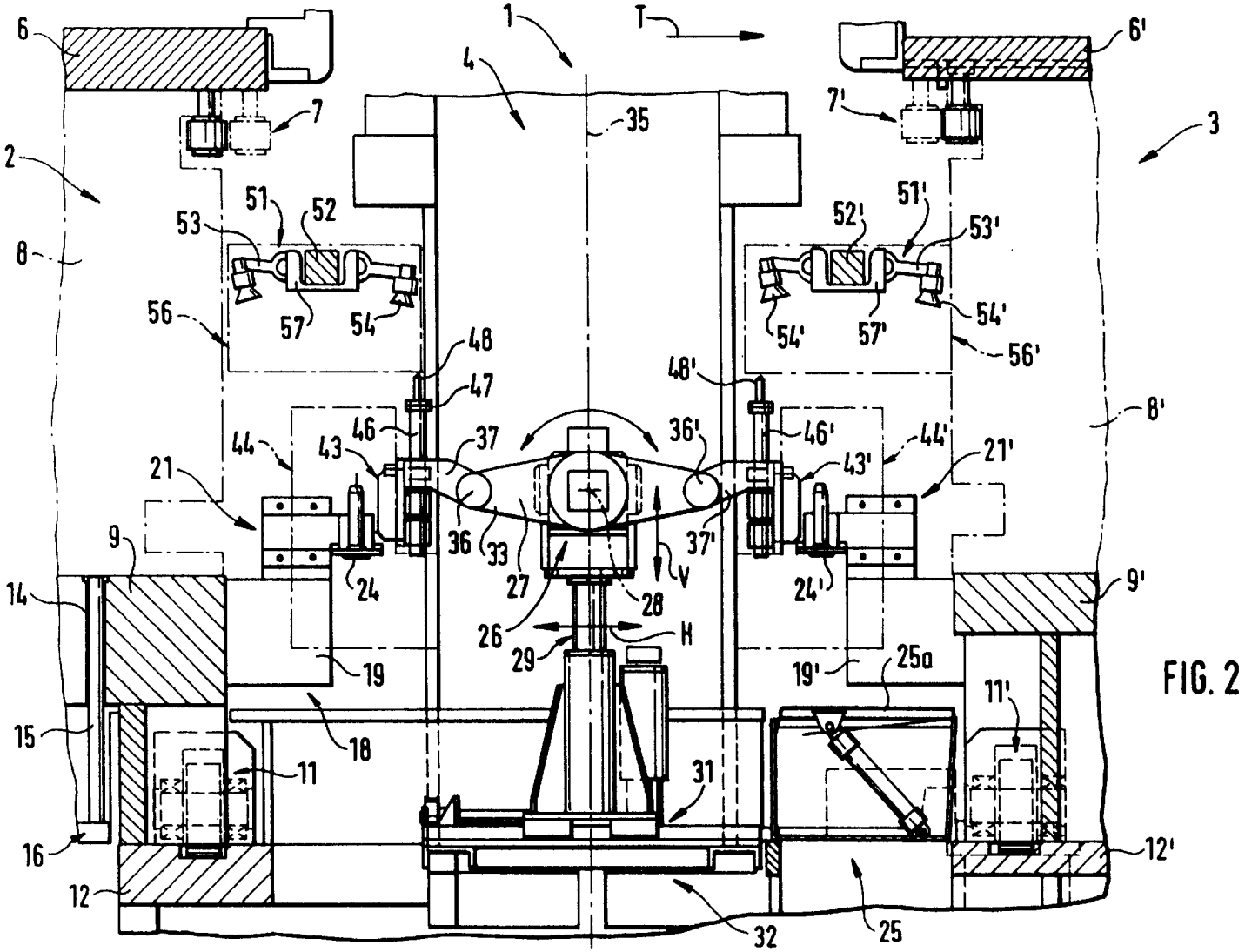
FIG. 2 is a partial, schematic side view of the press arrangement of FIG. 1, in which the intermediate depositing device is prepared for the change of the workpiece holding apparatus in that the workpiece templates have been swivelled into a storage position.

Based on this position, for the tool exchange, the arms 37, 37' are first swivelled by approximately 90° so that L-shaped areas 44, 44', in which the templates 43, 43' must be situated, extend substantially vertically. In this position as seen in FIG. 2, the receiving pins 46, 46' become upright and the pin parts 48, 48' carried by them point vertically upward. In this stage, the cross traverses 52, 52' of the transfer system are lowered to an appropriate transfer level.

Figure 3:
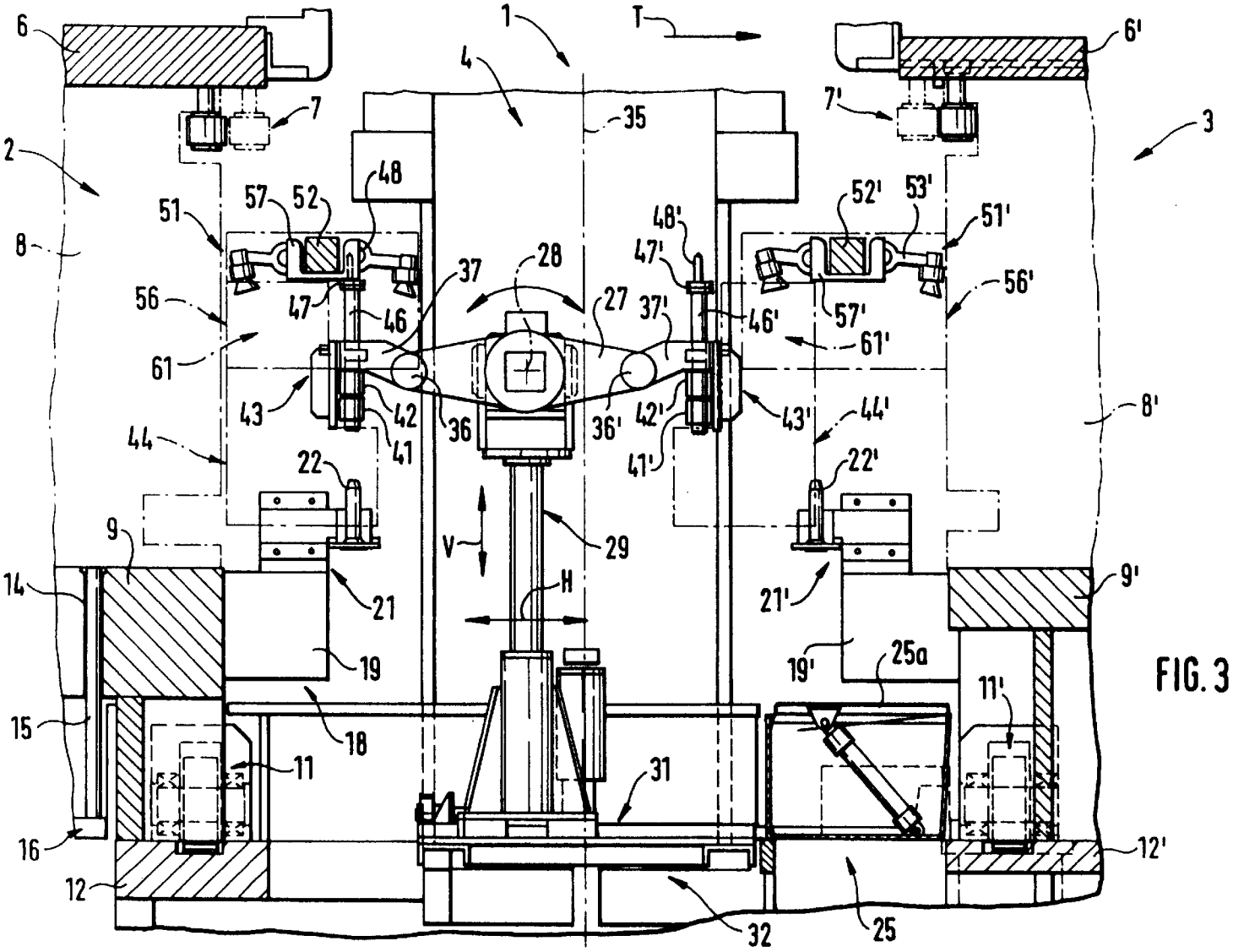
FIG. 3 is a partial schematic side view of the press arrangement of FIGS. 1 and 2, in which the intermediate depositing device has received a workpiece holding apparatus.

As shown in FIG. 3, the column 29 is now moved out in the vertical direction V in a telescopic manner so that the lifting head 26 and, together therewith, the receiving pins 46, 46', are guided vertically upwards. With respect to the longitudinal and transverse position, the cross traverse 52 and the guide 31 as well as the transverse guide 32 are controlled such that the pin part 48 relatively precisely finds a corresponding opening provided at the base frame 57 of the suction frame 51. The area 44, in which the templates 43 can be situated, and the area 46, in which the suction elements 54 can be situated, overlap one another in the overlapping area 61. The templates 43 are, however, arranged to be laterally offset with respect to the suction elements 54 so that there is no collision in the overlapping area 61. The transverse tubes 41, 42 span the waste shaft 25 and form a base for receiving the suction frames 51 which is particularly important when two or several suction frames 51 are held side-by-side on a cross traverse 52. These suction frames 51 are disposed on the transverse tubes 41, 42 which, in turn, are supported by only two holders (i.e., projections 19, pin 22).

During the lifting movement of the lifting head 26, the receiving pin 46 with its pin part 48' does not find a corresponding opening of the suction frame 51'. The reason is that, as a rule, the distance between the cross traverses 52, 52' differs from the distance between the receiving pins 46, 46' swivelled in the vertical direction.

Figure 4:
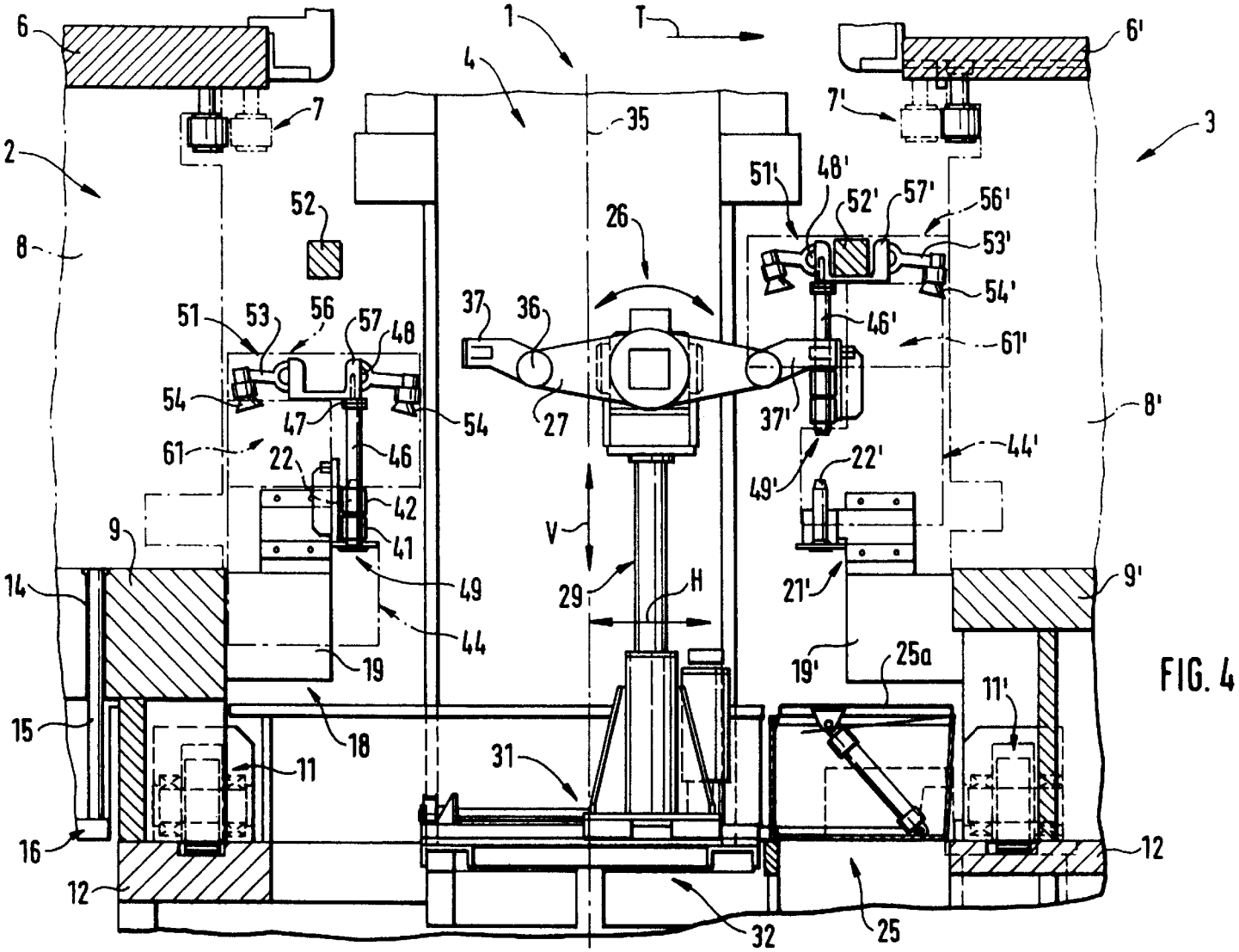
FIG. 4 is a similar view of the press arrangement of FIGS. 1 to 3 but after the depositing of a suction frame and of a template set on a sliding table and during the transfer of another suction frame to the intermediate depositing device.

In the next step shown in FIG. 4, the connection is opened up between the suction frame 51 and the cross traverse 52. For this purpose, the intermediate depositing station 4 is, for example, moved along the transverse guide 32, whereby the suction frame 51 is also moved along the cross traverse 52 and corresponding coupling devices open up. By the lowering of the lifting head 26, the holder formed by the receiving pins 46 and the transverse tubes 41, 42 is lowered and is fitted by corresponding openings onto the pins 22. The suction frame 51 and the templates 43 are now held on the sliding table 9. After the opening-up of the coupling device 38, the intermediate depositing station 4 on the guide 31 is adjusted such that the receiving pin 46' will first stand below the suction frame 51' and will then find a corresponding opening of the suction frame 51' with its pin part 48' as the result of the lifting of the lifting head 26. The detachment of the suction frame 51' from the cross traverse 52' and the deposition of the holder 49' on the pin 22' held on the sliding table 9' takes place as described above in connection with the holder 49.

Figure 5:
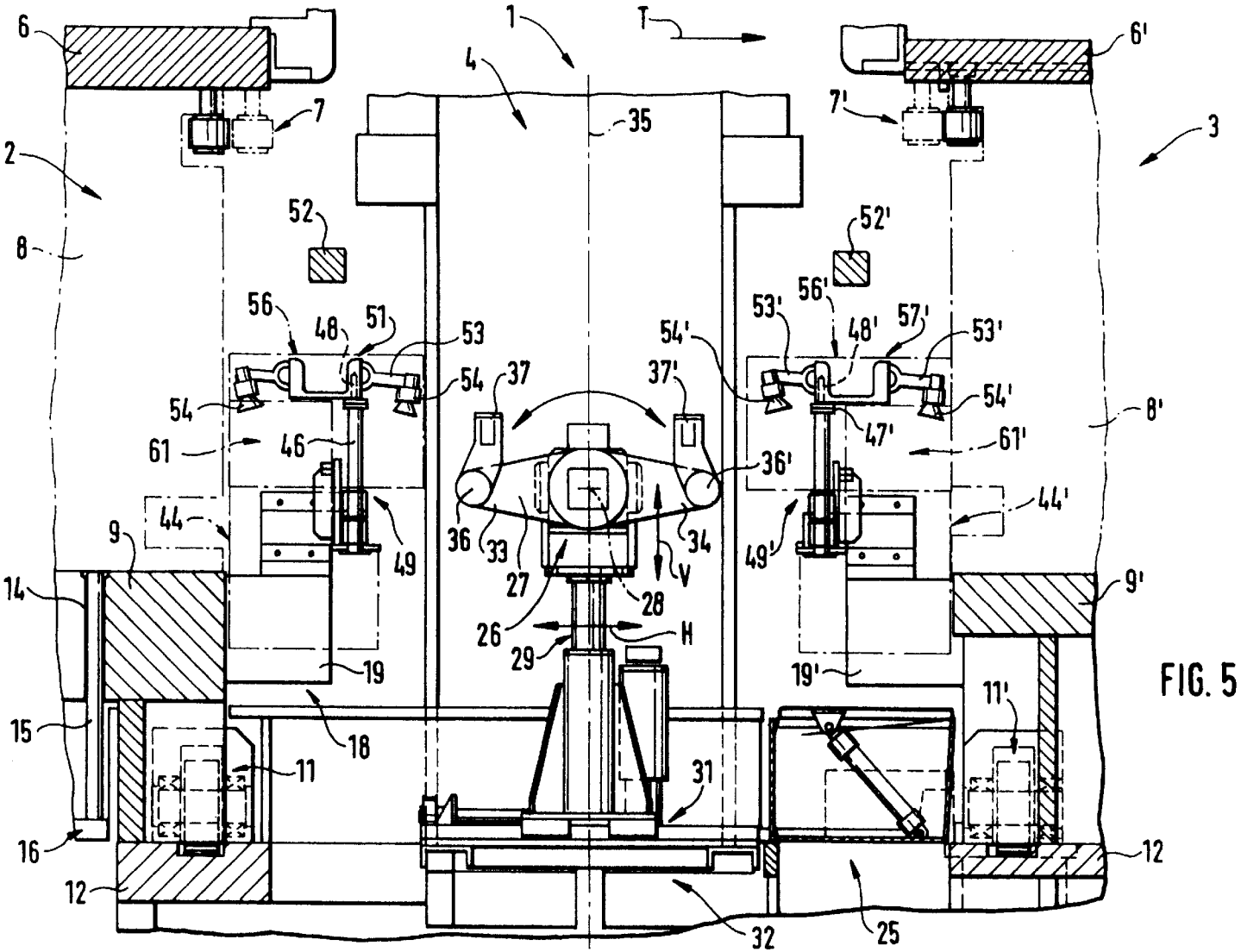
FIG. 5 is a similar view of the press arrangement of FIGS. 1 to 4 but with templates and suction frames deposited on the sliding tables, ready for the lateral moving-out of the sliding tables.

When the holders 49, 49' with the templates 43, 43' and the suction frames 51, 51' are deposited on the sliding tables 9, 9', the arms 37, 37' will be swivelled back into their inoperative position (as seen in FIG. 5) and the sliding tables 9, 9' with the molds 8, 8' and the tooling (templates 43, 43', suction frames 51, 51') can be moved out of the press arrangement 1.

In summary, a press arrangement 1 has sliding tables 9, 9' provided in the press stations 2, 3 to carry molds 8, 8'. Holding systems 22, 22' are provided on the sliding tables 9, 9' or on the molds 8, 8'. These holding systems 22, 22' are used for receiving holders 49, 49' which are arranged on the intermediate depositing station 4 arranged between the press stations 2, 3. The holders 49, 49' carry templates 43 for the intermediate deposition of workpieces. In addition, the holders 49, 49' have receiving devices 46, 48; 46', 48' for receiving workpiece-specific parts of the transfer system, particularly suction frames 51, 51'. During the mold exchange, the intermediate depositing station 4 is operated such that it receives the suction frames 51, 51' by way of its holders 49, 49', after which the holders 49, 49' are deposited on the holding systems 22, 22'.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Press arrangement having at least two press stations, comprising sliding tables operatively arranged in the press stations for receiving molds, the sliding tables arranged to be movable out of the respective press station as required, a transfer system for workpiece transport in a transport direction having a separable workpiece holding apparatus for temporary holding of workpieces, and at least one intermediate depositing device operatively arranged between two adjacent press stations and provided with workpiece depositing apparatus configured to support workpieces at a bottom surface thereof and a receiving device for the temporary holding of workpieces, wherein at least one of the sliding tables carries at least one holding device for the workpiece holding apparatus at a position separated from the transfer system, and the intermediate depositing device has at least one transfer device for receiving and transferring the workpiece holding apparatus from the transfer system to the at least one holding device.

2. Press arrangement according to claim 1, wherein the at least one holding device comprises a holding system for receiving the workpiece depositing apparatus carried by the at least one sliding table.

3. Press arrangement according to claim 2, wherein the holding system is provided on the at least one sliding table or on one of the molds.

4. Press arrangement according to claim 1, wherein the at least one transfer device comprises at least one holder operatively associated with the at least one holding device, operatively connected with the workpiece depositing apparatus and configured to receive the workpiece holding apparatus.

5. Press arrangement according to claim 1, wherein the transfer system has cross traverses on which, during press operation, the workpiece holding apparatus is held and from which the workpiece holding apparatus is removable, the cross traverses remaining in the transfer system.

6. Press arrangement according to claim 1, wherein the workpiece depositing apparatus comprises templates operatively held on supporting tubes which extend transversely to the transport direction.

7. Press arrangement according to claim 6, wherein the templates are offset in a direction transverse to the transport direction with respect to individual holding elements of the workpiece holding apparatus.

8. Press arrangement according to claim 1, wherein the at least one holding device carried by the at least one sliding table is configured to provide overlapping receiving areas for the workpiece holding apparatus and for the workpiece depositing apparatus.

9. Press arrangement according to claim 1, wherein the intermediate depositing device has at least one support with at least one free end, on which is disposed a swivel element adjustable about an axis and having a connecting device for connecting the workpiece depositing apparatus.

10. Press arrangement according to claim 4, wherein the at least one holder has at least one receiving pin which, in a workpiece depositing position of the intermediate depositing device, is swivellable into a horizontal position and, for exchanging the workpiece holding apparatus, is swivellable into a vertical position.

11. Press arrangement according to claim 9, wherein the at least one holder has at least one receiving pin which, in a working position of the intermediate depositing device, is swivellable into a horizontal position and, for exchanging the workpiece holding apparatus, is swivellable into a vertical position.

12. Press arrangement according to claim 1, wherein the intermediate depositing device has at least two translational and at least two rotational adjusting axes.

13. Method for tool exchange on a press arrangement having at least two press stations, a transfer system with workpiece holder for workpiece transport, an intermediate depositing device with workpiece receiving devices and corresponding devices for receiving the workpiece holders, sliding tables movable out of the press stations and on which molds are holdable, and at least one holding device carried by the respective sliding table on the respective mold, comprising the steps of:

transferring the workpiece holders of the transfer system to the intermediate depositing device receiving the workpiece holders from the transfer system by the intermediate depositing device, and transferring the workpiece holders to the at least one holding device carried by the respective sliding table or the respective mold.

14. Method according to claim 13, further comprising the step of changing the transfer system for the mold exchange into a transfer position, changing the intermediate depositing device from a working operative condition into a transfer operative condition in which transfer devices are activated, and engaging the transfer devices with the workpiece holder which are then detached from the transfer system and are guided from the intermediate depositing device to the respective sliding table and are transferred to the respective holding device situated thereat.

15. Method according to claim 14, wherein for the mold exchange, the respective sliding table with the associated mold, the workpiece depositing apparatus of the intermediate depositing station and the workpiece holders of the transfer system are removed from the press arrangement.

16. Method of using an intermediate depositing device of a press arrangement having at least two press stations, sliding tables arranged in the press stations for receiving molds, as required, the sliding tables being movable out of the respective press station, a transfer system for workpiece transport and having separable workpiece holders for temporary holding of workpieces, and at least one intermediate depositing device arranged between two adjacent press stations, and is provided with devices for depositing workpieces and a receiving device for the workpiece holders, comprising the step of using the intermediate depositing device for transferring the workpiece holders to a respective holding device provided on at least one of the sliding tables.

17. The method according to claim 16, wherein during mold exchange, sliding table constitutes a support and transport device for the mold and the tooling.

* * * * *